US010294735B2

(12) United States Patent
Ottersland

(10) Patent No.: US 10,294,735 B2
(45) Date of Patent: May 21, 2019

(54) SELF-ALIGNING APPARATUS

(71) Applicant: MHWIRTH AS, Kristiansand (NO)

(72) Inventor: Gjerulf Ottersland, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 231 days.

(21) Appl. No.: 15/302,168

(22) PCT Filed: Apr. 8, 2015

(86) PCT No.: PCT/EP2015/057575
§ 371 (c)(1),
(2) Date: Oct. 6, 2016

(87) PCT Pub. No.: WO2015/155211
PCT Pub. Date: Oct. 15, 2015

(65) Prior Publication Data

US 2017/0030152 A1 Feb. 2, 2017

(30) Foreign Application Priority Data

Apr. 8, 2014 (NO) ..... 20140461

(51) Int. Cl.

| | |
|---|---|
| ***B66D 3/06*** | (2006.01) |
| ***E21B 19/00*** | (2006.01) |
| ***E21B 15/00*** | (2006.01) |
| ***E21B 19/02*** | (2006.01) |
| ***E21B 19/086*** | (2006.01) |
| ***E21B 19/09*** | (2006.01) |

(Continued)

(52) U.S. Cl.
CPC ..... *E21B 19/008* (2013.01); *B66D 3/06* (2013.01); *B66D 3/08* (2013.01); *E21B 15/00* (2013.01); *E21B 19/02* (2013.01); *E21B 19/08* (2013.01); *E21B 19/086* (2013.01); *E21B 19/09* (2013.01); *B66D 2700/026* (2013.01)

(58) Field of Classification Search
CPC ..... B66D 3/06; B66D 3/08; B66D 2700/026; E21B 15/04; E21B 19/02; E21B 19/086; E21B 19/08; E21B 19/008; E21B 19/09
See application file for complete search history.

(56) References Cited

U.S. PATENT DOCUMENTS 2,233,648 A * 3/1941 Sounitza ..... B66D 3/06 254/416
2,340,750 A * 2/1944 Hlavaty ..... F16H 55/52 474/108

(Continued)

FOREIGN PATENT DOCUMENTS

GB 1 480 811 A 7/1977
GB 2 171 974 A 9/1986

(Continued)

*Primary Examiner* — Emmanuel M Marcelo
(74) *Attorney, Agent, or Firm* — Norman B. Thot

(57) ABSTRACT

A self-aligning apparatus for a lifting system includes a structure which includes a first element having a first projecting free end and a second projecting free end which each receive at least one sheave at a point of attachment to the first element, and at least two first points of rotation. The at least one sheave cooperates with at least one wire. The at least two first points of rotation are arranged above the at least one sheave's point of attachment to the first element so that the apparatus self-aligns during use in an uneven loading event.

22 Claims, 7 Drawing Sheets

(51) Int. Cl.
*B66D 3/08* (2006.01)
*E21B 19/08* (2006.01)

(56) References Cited

U.S. PATENT DOCUMENTS

| | | | | |
|---|---|---|---|---|
| 4,027,854 | A | 6/1977 | Mounton, Jr. | |
| 4,170,340 | A | 10/1979 | Mouton, Jr. | |
| 4,341,373 | A | 7/1982 | Mouton, Jr. | |
| 4,585,213 | A | 4/1986 | Slagle, Jr. et al. | |
| 4,688,764 | A | 8/1987 | Nayler et al. | |
| 4,742,993 | A * | 5/1988 | Montgomery | B63B 21/10 226/196.1 |
| 4,830,336 | A | 5/1989 | Herabakka | |
| 6,032,929 | A | 3/2000 | Vatne | |
| 6,202,274 | B1 | 3/2001 | Vatne | |
| 2011/0266064 | A1 | 11/2011 | Ledbetter | |
| 2012/0199396 | A1 | 8/2012 | Strange | |
| 2013/0112395 | A1 | 5/2013 | Story | |

FOREIGN PATENT DOCUMENTS

| | | | |
|---|---|---|---|
| NO | 160387 | B | 12/1987 |
| NO | 301384 | B1 | 6/1997 |
| NO | 303029 | B1 | 8/1997 |
| WO | WO 97/23705 | A1 | 7/1997 |
| WO | WO 2010/033947 | A2 | 3/2010 |
| WO | WO 2015/007412 | A2 | 1/2015 |

* cited by examiner

SELF-ALIGNING APPARATUS

CROSS REFERENCE TO PRIOR APPLICATIONS

This application is a U.S. National Phase application under 35 U.S.C. § 371 of International Application No. PCT/EP2015/057575, filed on Apr. 8, 2015 and which claims benefit to Norwegian Patent Application No. 20140461, filed on Apr. 8, 2014. The International Application was published in English on Oct. 15, 2015 as WO 2015/155211 A1 under PCT Article 21(2).

FIELD

The present invention relates to a self-aligning apparatus for use in a lifting system in, for example, a derrick or an inline compensator. The apparatus may be a yoke. The invention more specifically relates to an apparatus comprising a structure which can, for example, be supported by a plurality of hydraulic piston-cylinder arrangements and which, if the piston cylinders lift unequally, will "self-align" so that the structure straightens itself as a result of the configuration.

BACKGROUND

The exploration, drilling and production of hydrocarbons involves the use of land-based or offshore-located drilling rigs. The drilling rigs consist, for example, of a derrick with a hoisting system for lifting and lowering pipes and other equipment down to, and down into, the well. The hoisting system usually comprises wire or cable, a so-called drill line, a plurality of sheaves, a winch, a deadline anchor, and a storage drum, and is usually connected to sheaves on lifting devices in the derrick.

NO 301384 and NO 303029 describe, for example, the so-called Ram Rig™ concept which comprises a derrick comprising two hydraulic piston-cylinder arrangements for raising and lowering the drill string that is held in the derrick. The cylinders operate between the drill floor and a yoke which travels on guide rails in the derrick itself. A system of this kind makes it possible to position the drill floor at a higher level than the platform floor. The derrick can also be constructed with a significantly lower air resistance, and a higher safety level and a longer lifetime are attained for the most costly components of the derrick. The yoke more specifically comprises at least two sheaves to guide a respective wire, where the sheaves are rotatably attached to a rigid connection between the sheaves, and the rigid connection is rotatably connected to the upper end of each piston-cylinder arrangement. The rigid connection further consists of a beam running between the sheaves and two rotatable arms that extend obliquely upwards from the beam to the top end of each piston-cylinder arrangement.

NO 160387 describes a yoke for use in a derrick where the yokes are, however, operated by gear wheels in engagement with rack rails.

U.S. Pat. No. 4,027,854 describes a more detailed embodiment of a yoke for use in a derrick structure where the yoke is attached to a plurality of piston-cylinder arrangements via which the yoke is raised and lowered. The yoke is suspended in a crosshead beam via a central fastening bolt about which the yoke can pivot to offset the difference in lifting force and stroke length between the piston-cylinder arrangements. The yoke is, however, attached relatively rigidly to the piston rods in the piston-cylinder arrangements so that a misalignment of the yoke when pivoting about the central fastening bolt may result in large shear forces being exerted on the piston rods.

U.S. Pat. No. 4,885,213 describes a system for preventing a misalignment between different components in the system by seeking to achieve a uniform symmetric distribution of the forces on the components. While the objective of U.S. Pat. No. 4,885,213 is to prevent a misalignment, it nowhere describes a solution where the configuration of the device itself provides for a self-alignment.

A disadvantage of the prior art is that if the piston-cylinder arrangements lift the yoke operate unequally (e.g., different stroke of different cylinders), a displacement/uneven distribution of force on the beam (or the different points of attachment on which the forces act) against which the piston cylinders thrust results, and thereby an unequal distribution of force in different parts of the guide arrangement in which the yoke runs. Such a situation can, for example, result in damage to the equipment.

SUMMARY

An aspect of the present invention is to avoid at least some of the disadvantages associated with the prior art.

In an embodiment, the present invention provides a self-aligning apparatus for a lifting system. The self-aligning apparatus comprises a structure which comprises a first element comprising a first projecting free end and a second projecting free end which are each configured to receive at least one sheave at a point of attachment to the first element, and at least two first points of rotation. The at least one sheave is configured to cooperate with at least one wire. The at least two first points of rotation are arranged above the at least one sheave's point of attachment to the first element so that the apparatus self-aligns during use in an uneven loading event.

BRIEF DESCRIPTION OF THE DRAWINGS

The present invention is described in greater detail below on the basis of embodiments and of the drawings in which.

DETAILED DESCRIPTION

Figure 1:
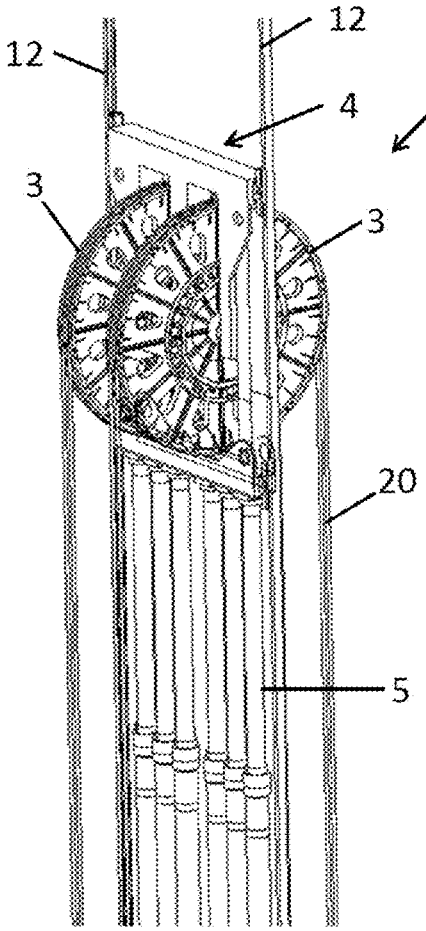
FIG. 1 shows a self-aligning apparatus according to the present invention arranged at the top of a derrick seen in an oblique side view.

The present invention provides a self-aligning apparatus comprising a structure, which structure can be raised/supported by a plurality of hydraulic piston-cylinder arrangements. The structure is configured so some "deformation" is allowed in order to maintain the load balance of a weight that is exerted on the structure. The set-up allows that, if there is unequal pushing force in one or more of the hydraulic piston-cylinder arrangements, the structure in which the sheaves are suspended will self-align so that the lifting forces are evenly distributed/evened out over the hydraulic piston-cylinder arrangements. The piston-cylinder arrangements typically consist of hydraulic lifting cylinders with a piston rod running in the cylinder. The piston-cylinder arrangements are normally two or more such lifting cylinders with a piston rod. Although the present invention is defined as a self-aligning apparatus comprising a structure, it is to be understood that throughout the description the terms "structure" and "apparatus" have been used with the same meaning, namely, the constructional feature(s) providing the self-alignment.

The present invention more specifically relates to a self-aligning apparatus for a lifting system comprising a structure, where the structure comprises a first element configured with first and second projecting free ends to receive at least one sheave, which sheave is provided to cooperate with at least one wire, where the first element is configured with at least two first points of rotation, and where the at least two first points of rotation are arranged above the at least one sheave's point of attachment to the first element, so that the apparatus, during use, will self-align in the event of uneven loading. It should be understood that the definition that the at least two points are arranged above the at least one sheave's point of attachment to the first element means above in a two-dimensional coordinate system in which gravity is the Y axis.

In an embodiment of the present invention, the structure can, for example, further comprise a first beam which is essentially parallel to a second opposing beam, which first and second beams can, through first end portions, be rotatably connected via the second element, and where the first element can be rotatably connected at opposing second end portions of the first and second beam.

The second element can, for example, be coincident with one or more lifting cylinders in the piston-cylinder arrangements and constitute the first and second beam. The structure in this embodiment will be an open structure, i.e., behave like an inverted triangle where the points of rotation are in each upper corner of the triangle, while the load is in the corner pointing downwards.

When some of the lifting cylinders in the piston-cylinder arrangements lift unequally, i.e., there is an unequal lifting height on the two sides of the structure, the sheaves, because of the deformation of the structure, will pull towards the side with highest lifting height, resulting in the first element rotating about the first points of rotation. The horizontal distance between the point of rotation on the side with the highest lifting height and the sheaves will thus decrease so that the vertical load acting on this side of the structure will increase. The opposite will happen on the side with lowest lifting height in the piston-cylinder arrangement, where the horizontal distance between the point of rotation and the sheaves will increase, while the vertical load acting on the side of the structure will decrease. The design of the apparatus allows the uneven weight distribution to be evened out as the side of the structure subjected to the relatively greater vertical load will have to resist such a relatively greater load, while the other side of the structure which is subjected to the relatively smaller vertical force will "catch up" with the other side. The apparatus thus self-aligns before it is subjected to an adverse uneven distribution of the load, an uneven distribution that in extreme consequence may damage the apparatus and associated guide arrangement etc.

In an embodiment of the present invention, a first and a second free end of the first element can, for example, be configured to lie adjacent against a length of the second end portions of the first and second beam.

In an embodiment of the present invention, the first and second free end of the first element can, for example, extend over at least half the length of the first and second beam. The first and second free ends can lie against each other, or they can be spaced apart, giving a small clearance, for example, a clearance between 1 to 100 mm. The clearance can, for example, be not so large so that the structure is not allowed to become too unaligned. The first and the second free end of the element can be configured with a hollow space that allows a certain play for the opposing end portions of the first and second beam. The first and the second free end of the element can optionally be solid without hollow spaces.

The first element can further be configured with at least a third free end arranged between the first and the second free end and extending in the same direction as the first and second free ends.

In an embodiment of the present invention, the free ends can, for example, comprise an attachment device for receiving the at least one sheave.

In an embodiment of the present invention, the attachment device for the at least one sheave can, for example, wholly or partly comprise through-going bores to receive a transverse shaft, where the at least one sheave is able to rotate together with, or optionally freely about, the shaft.

In an embodiment of the present invention, the structure can, for example, be configured with at least one bearing element in each corner which, in use, can be provided to cooperate with guide arrangements in a derrick.

In an embodiment of the present invention, the at least one bearing element can, for example, comprise rolling bearings in the form of ball bearings or wheel bearings.

In an embodiment of the present invention, the attachment device for the sheaves can, for example, comprise a shaft resting in two cups which projects from the first and second free ends. The shafts can be held in place, for example, by crescent-shaped clips or clamps. If the sheaves must be dismantled, for example, replaced if they are worn, they can easily be changed by removing the crescent-shaped clips, lifting the sheave up half the shaft diameter, and pulling the sheave forwards and out of the structure. The sheave can easily be hoisted/lowered down onto the drill floor in this position. This configuration gives an advantage in that a minimum of work must be carried out at height on the derrick.

In an embodiment of the present invention, the apparatus can, for example, be configured with a hanging device from which cable/wire, hoses etc. can hang temporarily while the sheaves are changed.

The present invention further relates to a derrick comprising at least two hydraulic piston-cylinder arrangements for raising and lowering an apparatus as described above, where the apparatus is placed at the upper end of the piston-cylinder arrangements, and where the apparatus can run axially up and down via guide arrangements in the derrick. As mentioned above, the apparatus in a simplified embodiment can be so configured that the second element coincides with one or more cylinders in the piston-cylinder arrangement and can constitute the first and second beam. The structure in this embodiment will have an open frame structure, i.e., behave like an inverted triangle, where the points of rotation are in each upper corner of the triangle, while the load is in the corner pointing downwards.

In an embodiment of the present invention, the guide arrangements in the derrick can, for example, comprise rails that cooperate with bearing element on the apparatus.

In an embodiment of the derrick of the present invention, the piston-cylinder arrangements can, for example, support the second element.

In an embodiment of the present invention, a self aligning yoke, e.g., a compensator sheave frame, for an inline compensation system is provided. Inline compensators are known in the art and provide active or passive compensation of a lifting wire, for example, in response to vessel heave at sea. One example of such a compensator is described in WO 2015/007412. In this system, the compensator is used in a multiline winch, i.e., having multiple parallel lifting wires. Using a high number of lifting wires in particular makes the travelling yoke longer and thus more prone to misalignments. The present invention, as incorporated in this specific embodiment, eliminates any operational problems associated therewith.

In an embodiment, the present invention also relates to an inline compensator comprising a self-aligning apparatus as described above.

In an embodiment of the inline compensator, the inline compensator can, for example, be a multiline compensator comprising at least four wires.

In an embodiment of the present invention, the inline compensator can, for example, comprise selectively engageable hydraulic cylinders. When using multiple hydraulic cylinders, of which individual cylinders (or pairs) are selectively engageable, the apparatus may be more sensitive to differences in the force applied from the cylinders, e.g., when using only the outer two cylinders.

A non-limiting embodiment of the present invention will now be described with reference to the attached drawings where like parts have been given like reference numerals.

Figure 2:
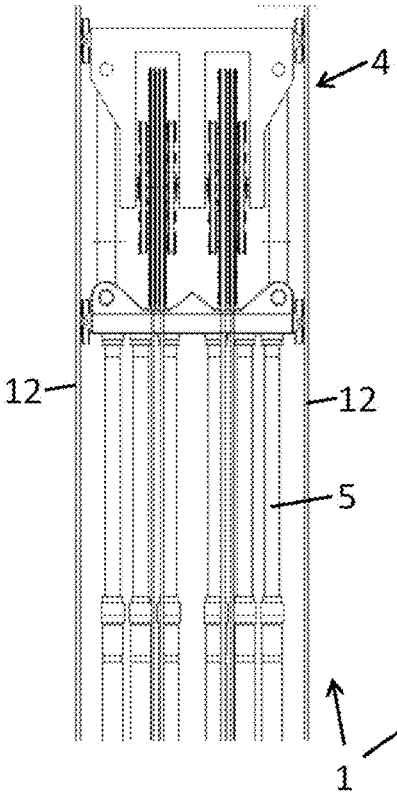
FIG. 2 shows a self-aligning apparatus according to the present invention arranged at the top of a derrick seen in a front view.
Figure 3:
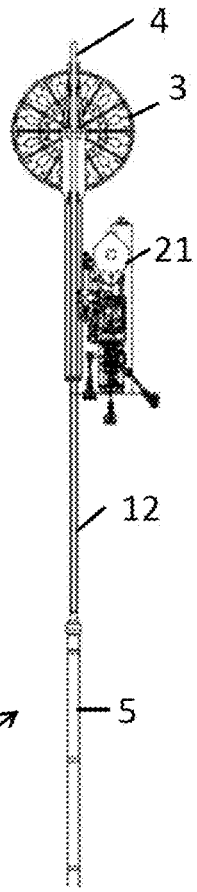
FIG. 3 shows a self-aligning apparatus according to the present invention arranged at the top of a derrick seen in a side view.

FIGS. 1, 2 and 3 show the apparatus according to the present invention arranged at the top of a derrick 1, seen respectively in an oblique side view (FIG. 1), in front view (FIG. 2) and in side view (FIG. 3).

As is evident from FIGS. 1-3, a derrick 1 is shown equipped with a self-aligning apparatus comprising a structure 4 according to the present invention. The structure 4 runs in the derrick 1 via rails 12.

At least one wire or cable 20 for holding, lifting and lowering a load runs over the sheaves 3. This is exemplified by a drilling machine 21 in FIG. 3.

Figure 4:
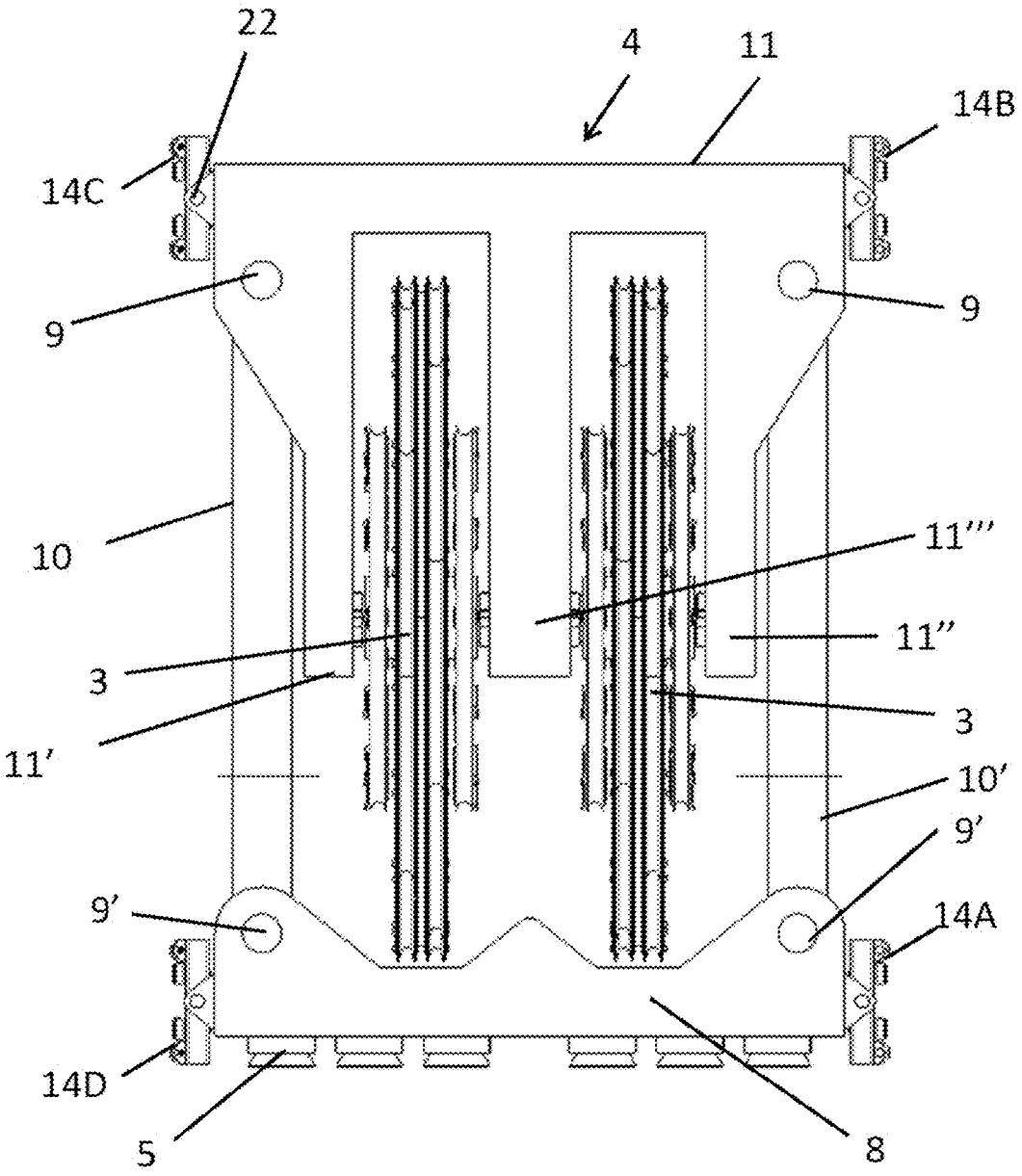
FIG. 4 shows the apparatus comprising a structure as seen in a front view.

The structure 4 runs on rails 12 vertically in the derrick 1 via bearing elements 14A-D (detailed in FIGS. 4 and 5) arranged on the side edges of the structure 4. The structure 4 is supported by a plurality of hydraulic piston-cylinder arrangements 5, which is a six piston-cylinder arrangement 5 in the shown embodiment. The configuration of the structure 4 allows that if the piston-cylinder arrangements 5 provide an unequal pushing force, so that the structure 4 is forced out of its neutral initial position (as shown in FIG. 4), the structure 4 will self-align in that the sheaves 3 will continue to maintain their essentially vertical orientation relative to a notional vertical plane that runs through the sheaves 3 in their neutral initial position. The magnitude of the skew motion before the self-aligning effect takes place can be regarded as negligible. The bearing elements 14A-D will therefore be in contact with the vertical rails 12 in the derrick (see FIGS. 1-3) under normal operating conditions.

Figure 5:
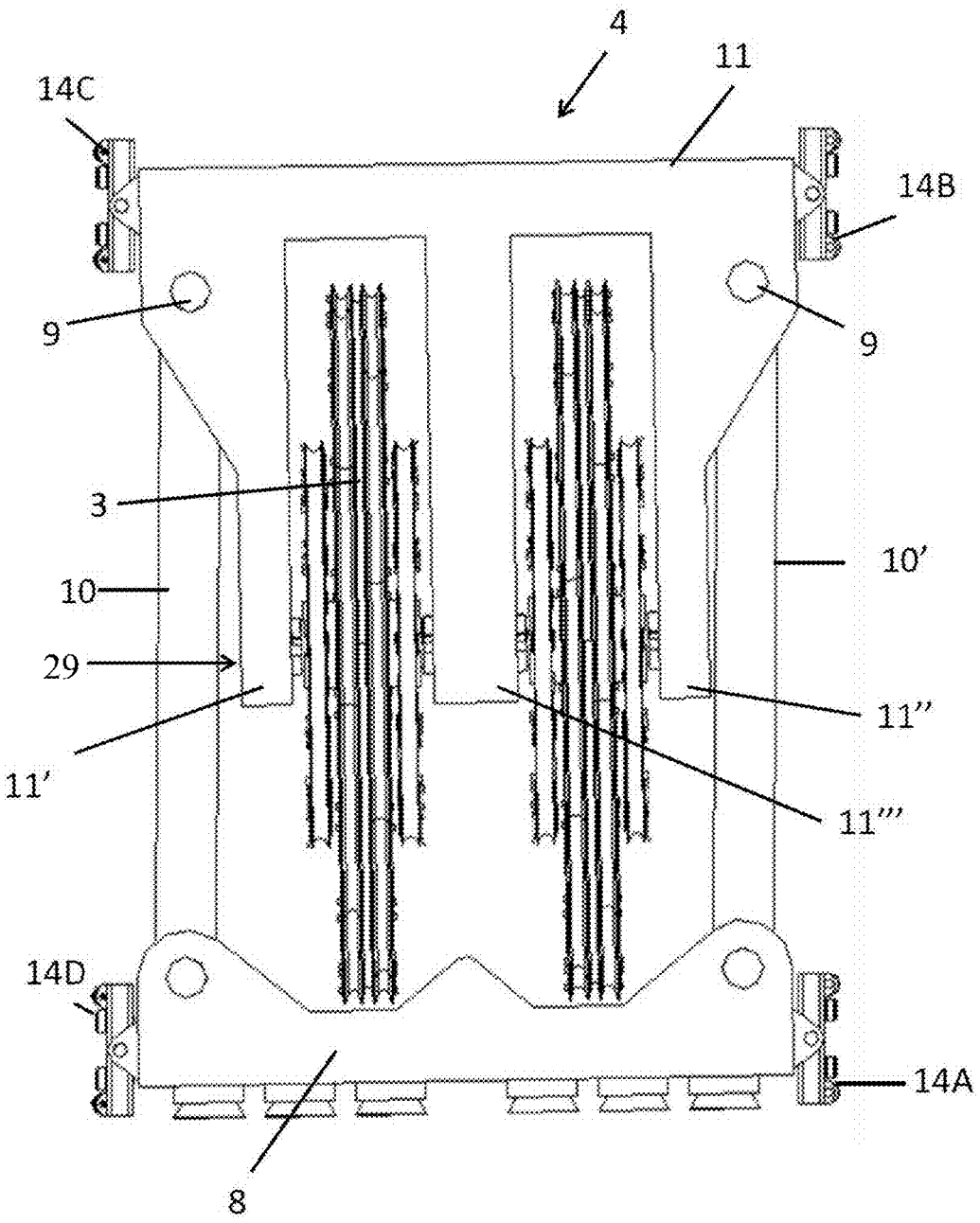
FIG. 5 shows the apparatus out of alignment, for example, as a result of an uneven load.

As shown in detail in FIGS. 4 and 5, the bearing elements 14A-D may, for example, be guiding rollers. The guiding rollers 14A-D can run internally in a typical U-beam (radial cross-section) or, optionally, in one half of a typical H-beam (radial cross-section) (not shown in the drawings). The guiding rollers 14A-14D can be rotatably connected to the structure via a rotatable connection 22.

A first element 11 is rotatably connected at the opposite second end portions of a first and second beam 10, 10', through first points of rotation 9 on each of the beams 10, 10'. The first and second beams 10, 10', at their first end portions, are rotatably connected to a second element 8 through second points of rotation 9'.

The first beam 10 is essentially parallel to the opposing second beam 10'. The first element 11 has a device (shown in detail in FIGS. 7-9) for receiving the sheaves 3. The first element 11 is furthermore configured with projecting free ends in the form of a first free end 11', a second free end 11", and a third free end 11'". The first and the second free end 11', 11" are adjacent along a length of the second end portions of the first and the second beam 10, 10'. The third free end 11'" is arranged between the first and the second free end 11', 11" and runs in the same direction as the first and second free ends 11', 11". The first, second and third free ends 11', 11", 11'" are configured with an attachment device 23, 24, 25 (see FIGS. 7-9) for receiving the sheaves 3.

In a simplified embodiment, the second element 8 can be coincident with one or more of the cylinders in the piston-cylinder arrangement, i.e., that one (or a group of) piston-cylinder arrangements 5 can run up to the first points of rotation 9 of the first element 11. In this embodiment, the piston-cylinder arrangements 5 constitute the first and second beam 10, 10' so that there will not be specific first and second beams 10, 10'.

FIG. 5 shows the structure in an exaggerated misalignment before a self-aligning process takes place. The sheaves 3 will here form an angle with a notional vertical line, that is to say, a line that is parallel to the sheaves when the sheaves are in their initial position with no load (FIG. 4), whereby this will load the sheaves 3 and the structure 4. Such a misalignment is undesirable because it will cause a greater load on sheaves 3, wires, bearing elements, and associated guide arrangements in the derrick 1, an uneven distribution of load etc. A fairly large gap is shown in FIG. 5 between the first beam 10 and the first free end 11' of the first element 11. This situation is a "worst-case scenario" that normally will not arise when using the present invention because the apparatus 4, before such a misalignment occurs, will self-align in that the lifting height of the piston-cylinder arrangements 5 operating on either side of the apparatus will be evened out before this happens, as a result of the distribution of force as described above, more specifically in the disclosed embodiment in FIG. 5. When some of the lifting cylinders in the piston-cylinder arrangements 5 lift unequally, i.e., that there is an unequal lifting height on the two sides of the structure/apparatus 4, the sheaves 3, because of the deformation of the structure 4, will pull towards the side with highest lifting height (in the right hand direction in FIG. 5), resulting in the first element 11 rotating about the first points of rotation 9. The horizontal distance between the point of rotation on the side with highest lifting height (in the right hand direction in FIG. 5) and the sheaves 3 will thus decrease (this can be seen in that the gap between the second beam 10' and the second free end 11" is smaller compared to FIG. 4), so that the vertical load acting on this side of the structure/apparatus 4 will increase. The opposite will happen on the side with lowest lifting height (the left hand side in FIG. 5) in the piston-cylinder arrangement 5, where the horizontal distance between the point of rotation and the sheaves 3 will increase (this can be seen in that the gap 29 between the first beam 10 and the first free end 11' is increased compared to FIG. 4), while the vertical load acting on the side of the structure will decrease. The design of the structure/apparatus 4 allows the uneven weight distribution to be evened out because the side of the structure/apparatus 4 subjected to the relatively greater vertical load will have to resist such a relatively greater load, and the other side of the structure/apparatus 4 that is subjected to the relatively smaller vertical force will "catch up" with the other side. The apparatus 4 thus self-aligns before it is subjected to an adverse uneven distribution of the load, an uneven distribution that in extreme consequence may damage the apparatus and associated guide arrangement etc.

Figure 6:
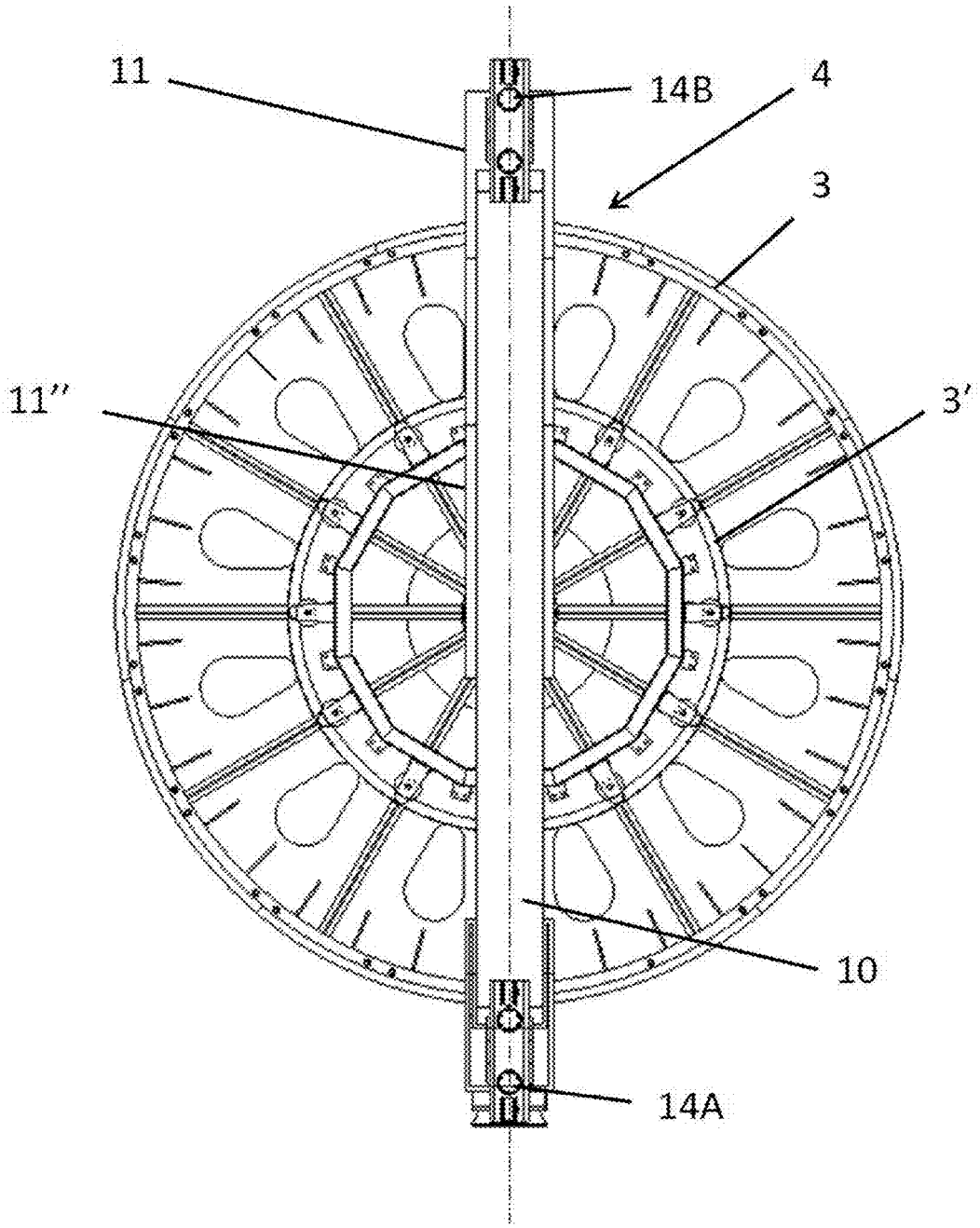
FIG. 6 shows the apparatus of FIG. 4 in a side view.

FIG. 6 shows the apparatus in a side view. A smaller sheave 3' can be seen in addition to the sheave 3 in FIG. 6 over which sheave smaller hoses, wires and cables etc. run during normal use.

Figure 7:
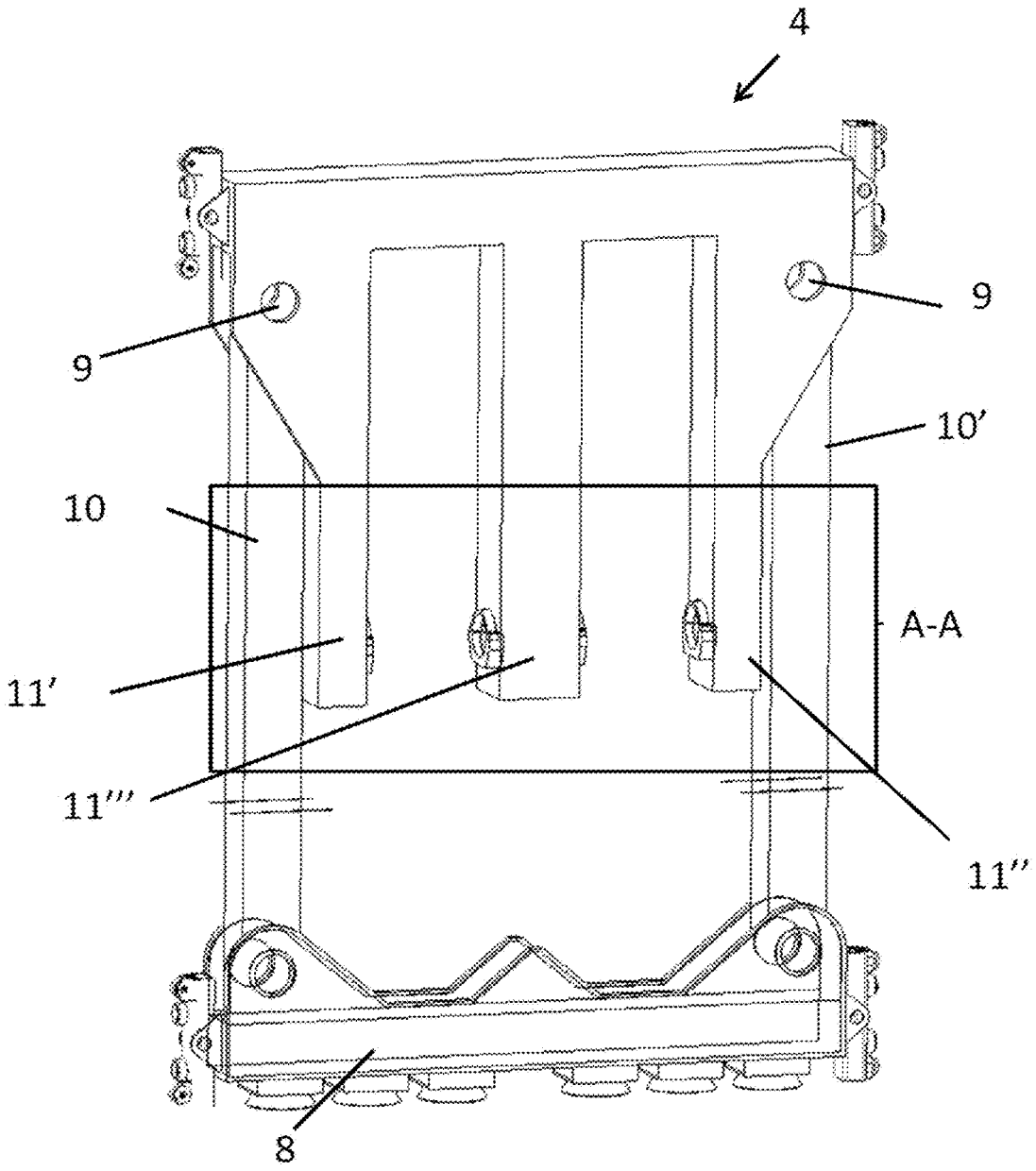
FIG. 7 shows the apparatus without sheaves in an oblique front view.
Figure 8:
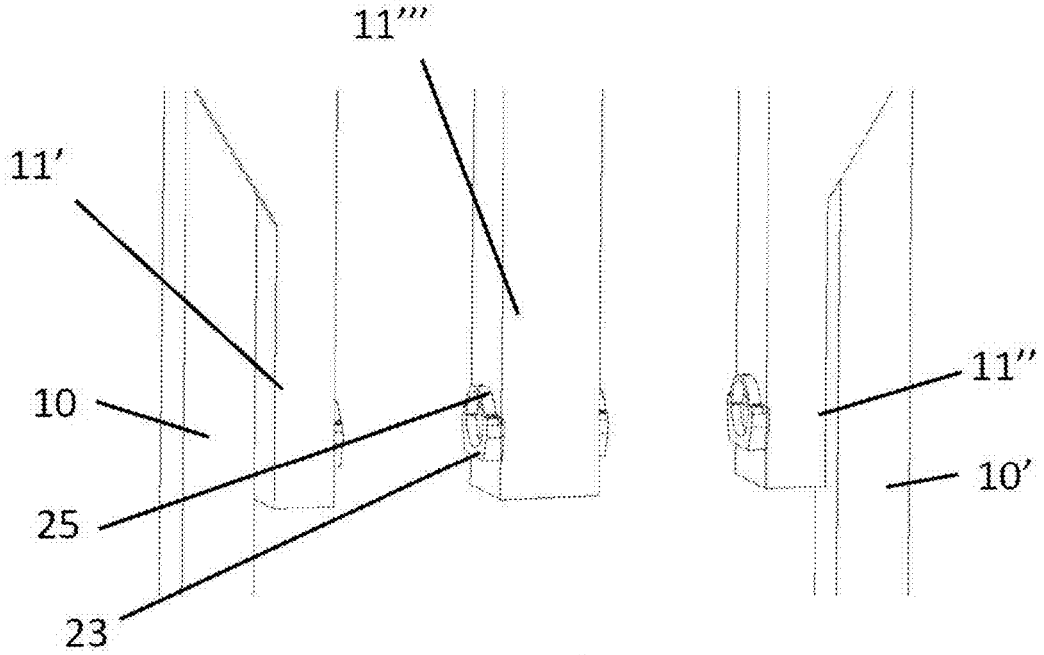
FIG. 8 shows a detailed view of the section A-A in FIG. 7.
Figure 9:
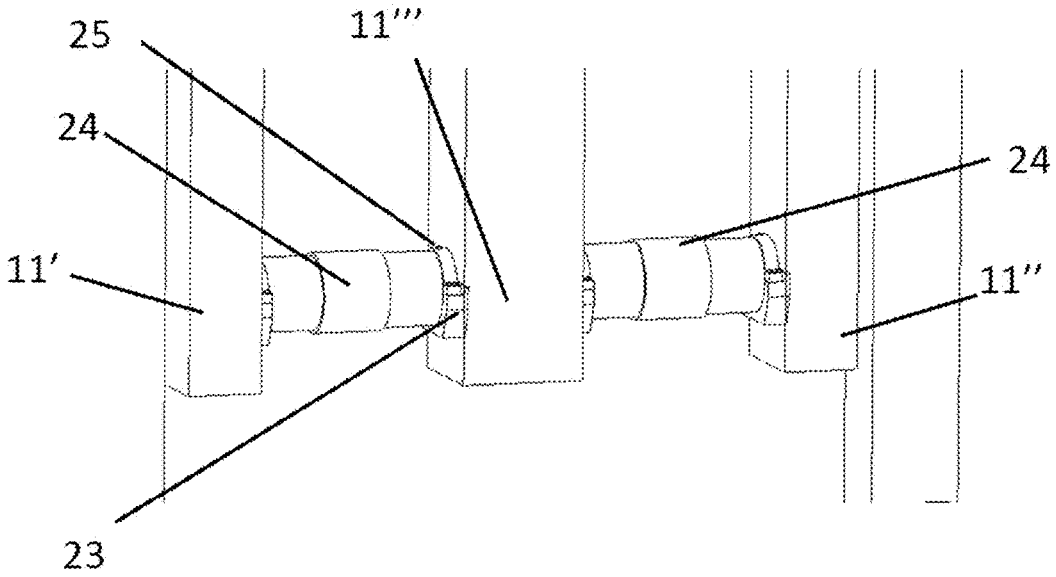
FIG. 9 shows the same details as in FIG. 8, but also including a transverse shaft for receiving the at least one sheave.

The sheaves 3 have been removed in FIGS. 7-9 in order better to show details of the attachment device 23, 24, 25 for the sheaves 3. FIG. 7 shows the apparatus without sheaves 3, seen in an oblique front view. FIG. 8 shows a detailed view of section A-A in FIG. 7, while FIG. 9 shows the same view as FIG. 8, but also showing the transverse shaft 24 to receive the at least one sheave 3. The attachment device 23, 24, 25 can comprise the shaft 24 (see FIG. 9) resting in two cups 23 that project from the first, second and third free ends 11', 11", 11". The shaft 24 can be held in place, for example, by crescent-shaped clips or clamps 25. If the sheaves 3 must be dismantled, for example, replaced if they are worn, they can easily be changed by removing the crescent-shaped clips or clamps 25, lifting the sheave 3 up half the shaft diameter, and pulling the sheave 3 forwards and out of the structure 4. The sheave 3 can easily be hoisted/lowered down onto the drill floor in this position.

The apparatus may be configured with a hanging device (not shown in the drawings) from which cable/wire, hoses etc. can temporarily hang while the sheaves 3 are changed. Such a hanging device can, for example, comprise any known device for suspension/hanging of cables, wires and hoses.

Figure 10:
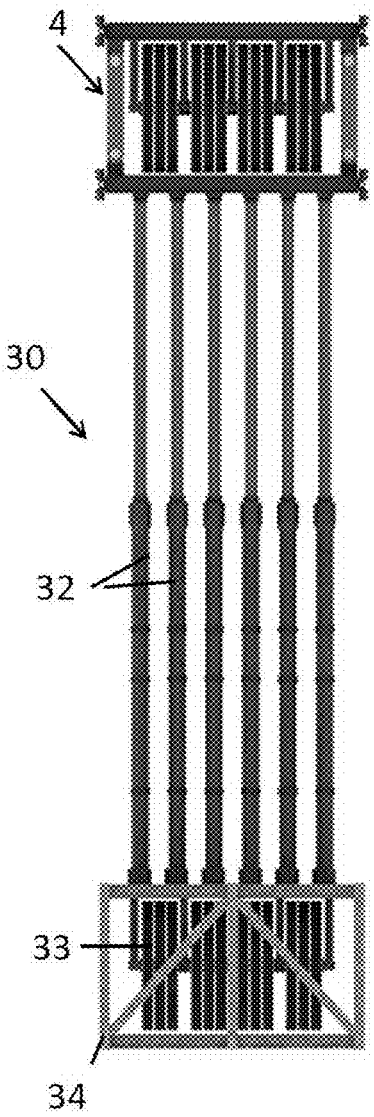
FIG. 10 shows a use of the apparatus according to the present invention where the apparatus is used in an inline compensator.
Figure 11:
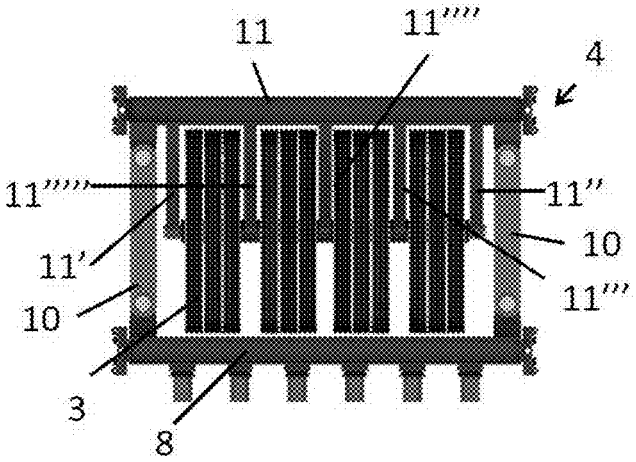
FIG. 11 shows a use of the apparatus according to the present invention where the apparatus is used in an inline compensator.

FIGS. 10 and 11 show another use of the apparatus 4 according to the present invention, where the apparatus 4 is used in an inline compensator 30. This use may, for example, be in connection with a drawworks in a lifting system. The apparatus 4 in FIG. 10 is exemplified as a compensator sheave frame arranged above a set of cylinders 32. The set of cylinders 32 disclosed has 6 cylinders, there can, however, be less or more sets of cylinders 32 dependent on the specific demand in the specific project. A total of four sheaves 3 (details shown in FIG. 11) are also disclosed. The apparatus 4 is the same apparatus 4 as disclosed in FIGS. 1-9, but with an additional number of sheaves 3 and projecting free ends 11', 11", 11'", 11"", 11""". In the embodiment shown in FIG. 10, lower sheaves 33 are also arranged in the lower end of the set of cylinders 32, but these lower sheaves 33 are optional. The frame 34 housing the lower sheaves 33 for supportive/fixed interaction with e.g., a drillfloor is also optional as it is also possible for the lower sheaves 33 to extend downwardly below/beneath a drillfloor.

An inline compensator 30 with an apparatus 4 according to the present invention may, for example, be employed in a compensator system as described in WO 2015/007412 (see, for example, FIGS. 8 and 9 of that document). By using the apparatus according to the present invention in such an inline compensation system, one can avoid problems associated with misalignments of the sheave frame arising, for example, from a different force being applied by the different hydraulic cylinders. In particular in the case of only a few selectable engageable cylinders driving the inline compensator (for example, the situation depicted in FIG. 9c of WO 2015/007412), small differences in the hydraulic force may create misalignments of the sheave frame, and an apparatus according to the present invention will eliminate problems associated therewith.

The embodiments described herein are only intended for illustrative purposes and should by no means be regarded as limiting. A person skilled in the art could make modifications or changes to the present invention without departing from the scope of the present invention, as defined in the appended claims. For example, the structure may have other configurations than the embodiments shown explicitly in the drawings, if such configurations facilitate self-alignment of the structure. The facilitation of the self-aligning effect will primarily depend on whether the points of rotation, i.e., the points of action, between the piston-cylinder arrangements 5 and the first element are above the tilting point for the load if it is envisaged that the points of rotation where the piston-cylinder arrangement acts (optionally via the first and second beam if the first element 8 is present) are at the upper ends of an inverted triangle with the load in the corner of the triangle pointing downwards. Reference should be had to the appended claims.

What is claimed is:

1. A self-aligning apparatus for a lifting system, the self-aligning apparatus comprising a structure which comprises:

a first element comprising a first projecting free end and a second projecting free end which are each configured to receive at least one sheave at a point of attachment to the first element, and at least two first points of rotation;

a second element;

a first beam comprising a first first beam end portion and a second first beam end portion; and a second beam comprising a first second beam end portion and a second second beam end portion, the second beam being arranged opposite to and substantially parallel to the first beam, wherein, the at least one sheave is configured to cooperate with at least one wire, the at least two first points of rotation are arranged above the at least one sheave's point of attachment to the first element so that the apparatus self-aligns during use in an uneven loading event, and the first beam and the second beam are connected to each other via a first rotatable connection between the second element, the first first beam end portion, and the first second beam end portion, and a second rotatable connection between the first element, the second first beam end portion, and the second second beam end portion.

2. The apparatus as recited in claim 1, wherein the first projecting free end and the second projecting free end of the first element are each configured to lie adjacent against a length of second first beam end portion and the second second beam end portion.

3. The apparatus as recited in claim 2, wherein the first projecting free end and the second projecting free end of the first element are each configured to run over at least half a length of the first beam and the second beam.

4. The apparatus as recited in claim 2, wherein the first element further comprises a third projecting free end arranged between the first projecting free end and the second projecting free end, the third projecting free end being configured to run in a same direction as the first projecting free end and the second projecting free end.

5. The apparatus as recited in claim 4, wherein the first projecting free end, the second projecting free end, and the third projecting free end each comprise a respective attachment device which is configured to receive the at least one sheave.

6. The apparatus as recited in claim 5, wherein the structure further comprises:

a traverse shaft, wherein, each respective attachment device comprises wholly or partly through-going bores configured to receive the transverse shaft, and the at least one sheave is configured to rotate together with or freely about the traverse shaft.

7. The apparatus as recited in claim 1, wherein the structure further comprises:

at least one bearing element arranged in each corner which, during use, is configured to cooperate with guide arrangements in a derrick.

8. The apparatus as recited in claim 7, wherein the at least one bearing element comprises rolling bearings.

9. A derrick comprising:

at least two hydraulic piston-cylinder arrangements configured to raise and lower the self-aligning apparatus as recited in claim 7, wherein, the self-aligning apparatus is positioned at an upper end of the at least two piston-cylinder arrangements, and the self-aligning apparatus is configured to run axially up and down via the guide arrangements in the derrick.

10. The derrick as recited in claim 9, wherein the guide arrangements comprise rails which are configured to cooperate with the at least one bearing element of the self-aligning apparatus.

11. The derrick as recited in claim 9, wherein the piston-cylinder arrangements are configured to support the second element.

12. An inline compensator comprising the self-aligning apparatus as recited in claim 1.

13. The inline compensator as recited in claim 12, wherein the inline compensator is a multiline compensator comprising at least four wires.

14. The inline compensator as recited in claim 12, wherein the inline compensator comprises hydraulic cylinders which are configured to be selectively engageable.

15. A self-aligning apparatus for a lifting system comprising a plurality of sheaves comprising at least a first sheave and a second sheave, the self-aligning apparatus comprising a structure which comprises:

a first element comprising, a first projecting free end, a second projecting free end, and a third projecting free end which is arranged between the first projecting free end and the second projecting free end, each of the first projecting free end and the second projection free end being configured to receive at least one sheave of the plurality of sheaves at a point of attachment to the first element, and at least two first points of rotation, the third projecting free end being configured to run in a same direction as the first projecting free end and the second projecting free end, and the first projecting free end, the second projecting free end, and the third projecting free end each comprising a respective attachment device which is configured to receive at least one sheave of the plurality of sheaves, wherein, each of the plurality of sheaves is configured to cooperate with at least one wire, the first sheave of the plurality of sheaves is held between the first projecting free end and the third projecting free end, the second sheave of the plurality of sheaves is held between the second projecting free end and the third projecting free end, each of the plurality of sheaves has a same axis of rotation, and the at least two first points of rotation are arranged above plurality of sheaves' point of attachment to the first element so that the apparatus self-aligns during use in an uneven loading event.

16. The self-aligning apparatus as recited in claim 15, further comprising:

at least one bearing element arranged in each corner which, during use, is configured to cooperate with guide arrangements in a derrick.

17. A derrick comprising:

at least two hydraulic piston-cylinder arrangements configured to raise and lower the self-aligning apparatus as recited in claim 16, wherein, the self-aligning apparatus is positioned at an upper end of the at least two piston-cylinder arrangements, and the self-aligning apparatus is configured to run axially up and down via the guide arrangements in the derrick.

18. The derrick as recited in claim 17, wherein the guide arrangements comprise rails which are configured to cooperate with the at least one bearing element of the self-aligning apparatus.

19. An inline compensator comprising the self-aligning apparatus as recited in claim 15.

20. The inline compensator as recited in claim 19, wherein the inline compensator is a multiline compensator comprising at least four wires.

21. The inline compensator as recited in claim 19, wherein the inline compensator comprises hydraulic cylinders which are configured to be selectively engageable.

22. The inline compensator as recited in claim 21, further comprising:

a frame comprising lower sheaves; and a plurality of hydraulic cylinders, wherein the plurality of hydraulic cylinders are arranged between the self-aligning apparatus and the frame.

* * * * *